United States Patent [19]

Watanabe et al.

[11] Patent Number: 4,566,252

[45] Date of Patent: Jan. 28, 1986

[54] METHOD FOR AUTOMATIC PACKING OF ARTICLES CAPABLE OF PROVIDING PLASTICS PACKING BAG WITH REINFORCED HANDLE PORTION

[75] Inventors: Hideyuki Watanabe; Yoshimitu Ichikawa, both of Tokyo, Japan

[73] Assignee: Taiyo Shokai Co., Ltd., Japan

[21] Appl. No.: 589,334

[22] Filed: Mar. 14, 1984

[30] Foreign Application Priority Data

Mar. 18, 1983 [JP] Japan ..... 58-45691

[51] Int. Cl.[4] ..... B65B 9/13; B65B 9/20; B65B 61/20

[52] U.S. Cl. ..... 53/410; 53/413; 53/451

[58] Field of Search ..... 53/134, 373, 410, 413, 53/451, 459, 469, 479, 481, 552, 570; 493/226, 926

[56] References Cited

U.S. PATENT DOCUMENTS

| | | | |
|---|---|---|---|
| 2,103,386 | 12/1937 | Salfisberg | 53/451 X |
| 2,294,220 | 8/1942 | Albertson | 53/451 X |
| 2,983,087 | 5/1961 | Schofield | 53/479 X |
| 3,543,466 | 12/1970 | Forsberg | 53/459 X |
| 3,732,661 | 5/1973 | Goldberger | 53/373 X |
| 3,954,049 | 5/1976 | Brieske | 493/926 X |
| 4,201,031 | 5/1980 | Wiles | 53/459 X |

*Primary Examiner*—Robert L. Spruill
*Assistant Examiner*—Michael D. Folkerts
*Attorney, Agent, or Firm*—McGlew and Tuttle

[57] ABSTRACT

An improved method for the automatic packing of articles in which bag sections are successively made of tubular plastics bag material which is intermittently conveyed. Goods are charged into a bag section formed at the leading end of the bag material. Thereafter the goods-charged bag section is heat-sealed at an opening portion thereof and separated from a subsequent bag section of the bag material. In accordance with the invention, before charging the bag section with goods, a piece of reinforcing sheet is inserted in and secured to the foremost bag section to form a reinforced handle portion having an opening for suspension of the finished bag.

6 Claims, 22 Drawing Figures

A
13
17
19
B
D
F
13

A
13
17
B
D
E
F
13

A
13
17
19
13
F
C'

A
17
B
19
E
F
C'
D
13

METHOD FOR AUTOMATIC PACKING OF ARTICLES CAPABLE OF PROVIDING PLASTICS PACKING BAG WITH REINFORCED HANDLE PORTION

BACKGROUND OF THE INVENTION

1. Field of the Invention

The present invention relates to improvements in or relating to a method and apparatus for automatic packing of articles, such as electronic elements, notions, small wares for outdoor amusement, such as fish-hoods and floats, stationery and foodstuff etc. by the use of a tubular bag material made of a thermoplastic synthetic resin, such as vinyl or polyethylene.

2. Description of the Prior Art

In conventional packing apparatuses such as shown in FIGS. 1 to 3, a packing operation with the use of the tubular plastics bag material A is performed as described below. First, the bag material A is intermittently conveyed by conveyor means, such as a pair of intermittently operated pinching rollers 10, 10*a* or pinch members 25, for a distance corresponding to the length of one single bag, then during an inoperative interval of the conveyor means, the bag material A is heat-sealed transversely across the same to form a bag section B at its leading end by heat-sealing means 11 which comprises a pair of heat-sealing members. Then, goods E are filled into the foremost bag section B, which depends downwardly from the subsequent bag section, by goods-supplying means 16. After the goods have been supplied to the foremost bag section B, the goods-charged bag section is heat-sealed along its opening portion by the heat-sealing means 11 or other sealing means 14 and finally, the goods-charged bag section B is separated, as a sealed pack C, from the subsequent bag section B of the bag material A.

In order that the sealed pack C thus obtained may be suspended from a hanger for the purpose of display at a store or the like, it is necessary to attach a piece of cardboard D having an opening for suspension to the upper or lower sealed portion by means of staples 3 or by the use of hand-operated fastening means (see FIGS. 1 to 4). Such handwork is not only troublesome and inefficient, but also cannot obtain beautiful and regularly finished packs.

SUMMARY OF THE INVENTION

The present invention is intended to eliminate the inconveniences and drawbacks indicated with the conventional methods and apparatuses for packing of articles described above and to provide an improved method and apparatus for automatic packing of articles that can automatically provide sealed packs C which can be suspended from hanger means for display without being readily deformed or spoiled by gravity.

Another object of the present invention is to provide an improved method and apparatus for automatic packing of articles of the character described above of which a feature resides in that a piece of reinforcing material sheet is inserted in and secured to the foremost bag section, before the goods are charged thereinto, to form a reinforced handle portion having an opening for suspension.

Other objects and advantageous features of the present invention will become apparent from the following description taken in conjunction with the accompanying drawings.

DESCRIPTION OF THE PREFERRED EMBODIMENTS

Prior to a detailed description of the method and apparatus according to the present invention, description will now be made in further detail as to the conventional packing apparatuses briefly referred to above.

Figure 1:
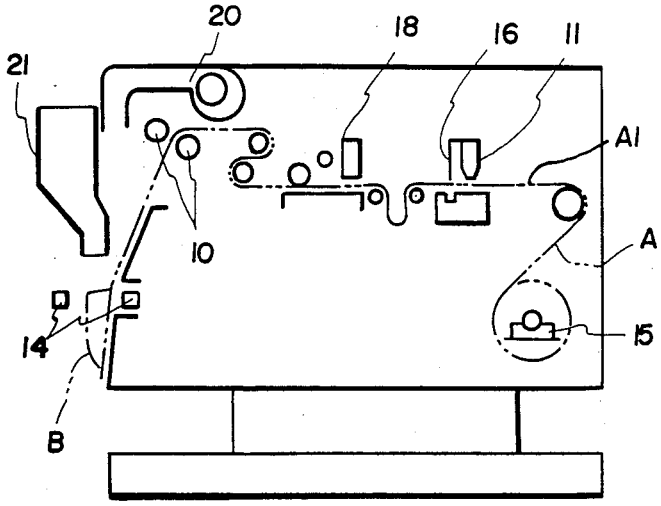
FIG. 1 (PRIOR ART)
FIG. 1 is a diagrammatic side view of one form of the conventional packing apparatus.
Figure 4:
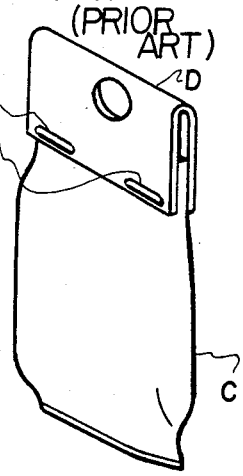
FIG. 4 (PRIOR ART)
FIG. 4 is a perspective view of a known sealed pack having a hangle portion for suspension.

In the conventional packing apparatus of one type shown in FIG. 1, a collapsed film tube A which is made of termoplastic synthetic resin by inflation molding is used as a bag material. The film tube A wound into the form of a roll and loaded on a roll support 15 is drawn and pinched between a pair of intermittently operated pinching rollers 10 to be intermittently conveyed. Indicated by reference numeral 16 is a serrated cutter which forms transversely extending discontinuous perforations 17 in the film tube A on both sides thereof at a portion parallel to and downstream of a transversely extending heat-sealed portion 13 formed by the heat-sealing means 11 (also see FIG. 5). Opener means 18 provided downstream of the serrated cutter 16 is arranged to form a transversely extending opening 19 in the upper film side or portion A1 of the film tube A by severing the upper portion along the row of the discontinuous perforations 17 therein in such a way that the upper film portion is moved relative to the lower film portion of the film tube A.

In this manner; a series of interconnected bag sections B are formed. Then during each inoperative interval of the rollers 10, the foremost bag section B passed therethrough and depending therefrom is inflated by a blow of an air blower 20 and then after the goods E have been charged into the foremost bag section B through the goods-supplying means 21, the bag section is heat-sealed along its opening portion 19 by the sealing means 14 having a pair of heat-sealers and separated from the subsequent bag section at the lower discontinuous perforation 17, whereby an individual goods-charged bag C is obtained.

Figure 2:
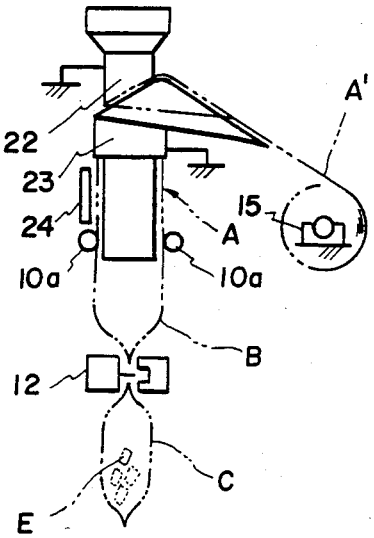
FIG. 2 (PRIOR ART)
FIG. 2 is a diagrammatic side view of another form of the conventional packing apparatus.
Figure 6:
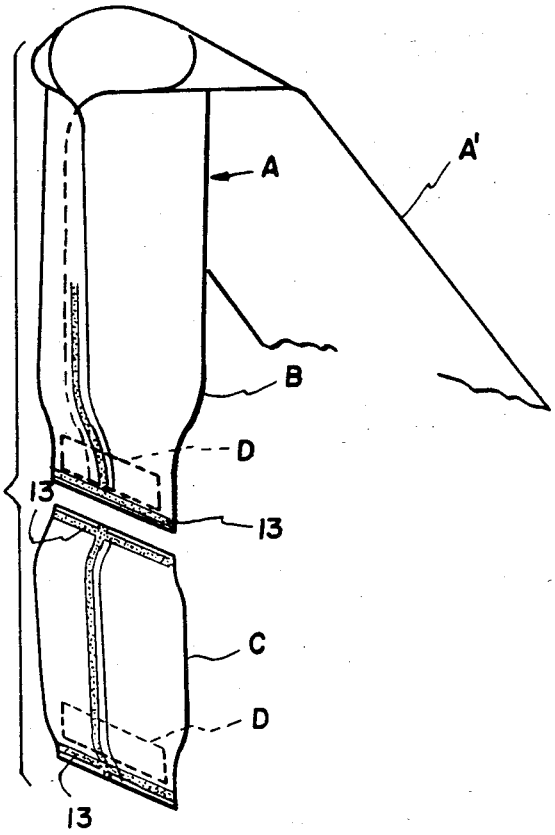
FIG. 6 is a perspective view of a bag material as used in the apparatuses shown in FIGS. 2 and 3.

In another form of the conventional packing apparatus shown in FIG. 2, a film tube A formed of a film strip A' of thermoplastic synthetic resin is used to form bag sections B. The film strip A' wound into the form of a roll and supported on a roll support 15 is drawn and led to a cylindrical structure comprising inner and outer cylindrical guide member 22, 23, then it is lapped around the inner cylindrical guide member 22 in such a way that an overlap of side edge portions of the strip A' is formed longitudinally along the inner cylindrical guide member 22 to thereby form the film strip into a tubular form, then the longitudinally extending overlap is longitudinally heat-sealed to form a film tube A by means of the vertical heat-sealing device 24. Thereafter, the film tube A thus formed is transversely heat-sealed at its leading end depending from the Cylindrical member 22 by means of a pair of heat-sealers 12 each having two lateral heat-sealing members to form two transversely extending vertically slightly spaced parallel heat-sealed portions 13, 13 which form the bottom portion of a bag section B (see FIG. 6).

Thereafter, the film tube A is downwardly moved for a distance corresponding to the length of a single bag section by means of intermittent pinch rollers 10*a*, then goods E are charged into the dependent foremost bag section B through the inner cylindrical member 22 from hopper means. Then, the film tube A is transversely heat-sealed by the heat-sealers 12 to seal an upper portion of the goods-charged bag section B and at the same time to form a transversely extending bottom portion of the subsequent bag section B, and then the goods-charged bag section is cut off from the subsequent bag section of the film tube at a portion between the two vertically spaced parallel heat-sealed portions, whereby a sealed pack C is obtained.

Figure 3:
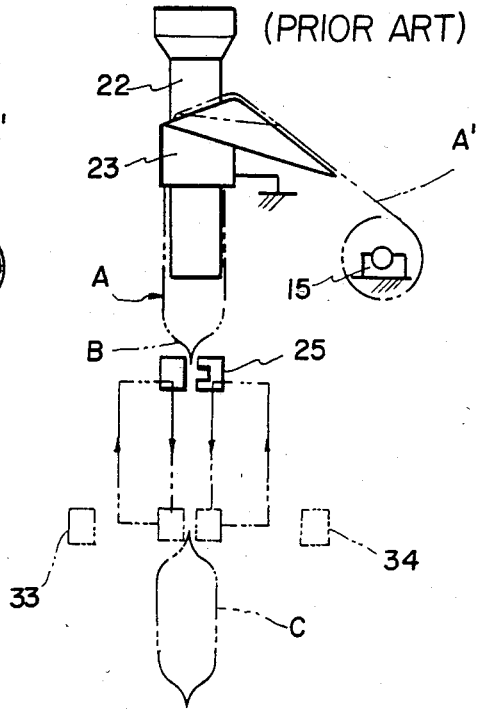
FIG. 3 (PRIOR ART)
FIG. 3 is a diagrammatic side view of a further form of the conventional packing apparatus.

Another form of the conventional packing apparatus shown in FIG. 3 differs from the second one shown in FIG. 2 in that a pair of vertically movable pinching members 25 having heat-sealing means for transversely heat-sealing the film A is employed which serves also as an intermittent conveyor means for the film tube A instead of the intermittent pinch rollers 10*a*.

The present invention will now be described in further detail with reference to FIGS. 5 to 17.

A reinforcing material D which is used to form a reinforced handle portion C' of sealed pack C in the present invention must be one which is stronger than the film tube A (hereinafter referred to as "tubular plastics bag material" or "bag material"), in other words, the former must have greater rigidity or stiffness than that of the latter. It is preferable that the reinforcing material is made of heat-weldable plastics which can meet this requirement. If the reinforcing material sheet made of such plastics is hard, then it may be a thin sheet. However, if it is soft, it must be a thick one. Other materials, for example, a sheet made of foamed plastics, a hardboard, a paper coated or laminated with heat-weldable plastics material, etc. can also be used as reinforcing materials. A reinforcing material to be actually used may be suitable selected from among these materials, taking into account size, shape, weight, etc. of individual sealed packs C to be made.

An individual piece of reinforcing material D may take either the form of a cord or the form of a V in folio or may be of a size which corresponds to the breadth of a bag, or it may generally be as large as an opening F to be formed in the handle portion C' for suspension.

The number of openings F may generally be one or two. Usually, the opening F has a circular shape, but it may be elliptical or may take the form of a hook-like cut-out or slit, X-shaped cut, I-shaped cut, inverted V or U-shaped cut or the like (see FIGS. 7, 9 and 16(*a*) to 16(*f*)).

Indicated generally by reference numeral 26 is means for supplying reinforcing material D1 to a dependent bag section B of the tubular plastics bag material A, which is located in the vicinity of the dependent bag section B.

Figure 11:
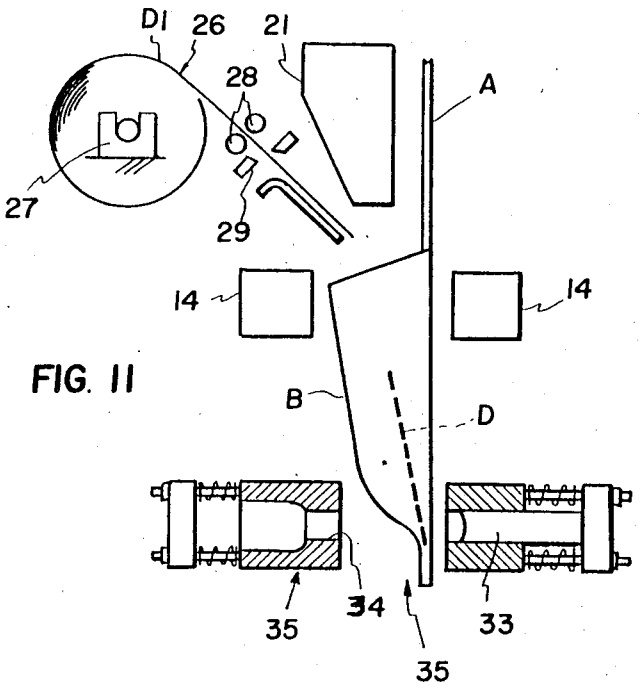
FIG. 11 is a partially vertically cross-sectioned, schematic side view showing a principal portion of one embodiment of the present invention as applied to the apparatus shown in FIG. 1.

The supply means 26 shown in FIG. 11 comprises a supporting device 27 for supporting a strip-like reinforcing material sheet D1 wound into the form of a roll, intermittent transfer means 28 for intermittently transferring the material sheet D1 for a predetermined distance and means 29 for cutting the material sheet D1 into an individual section D and for feeding it into the foremost bag section B with its opening portion 19 opened.

Figure 12:
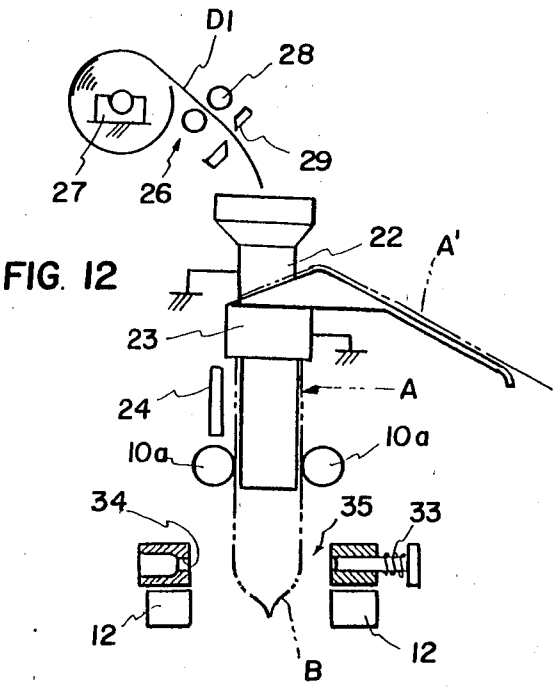
FIG. 12 is a partially vertically cross-sectioned, schematic side view showing a principal portion of another embodiment of the present invention as applied to the apparatus shown in FIG. 2.

The supply means 26 shown in FIG. 12 is located above the cylindrical guide member 22 and arranged to gravitationally feed a reinforcing material D formed by the cutting means 29 into the dependent foremost bag section B through the guide member 22.

Figure 15:
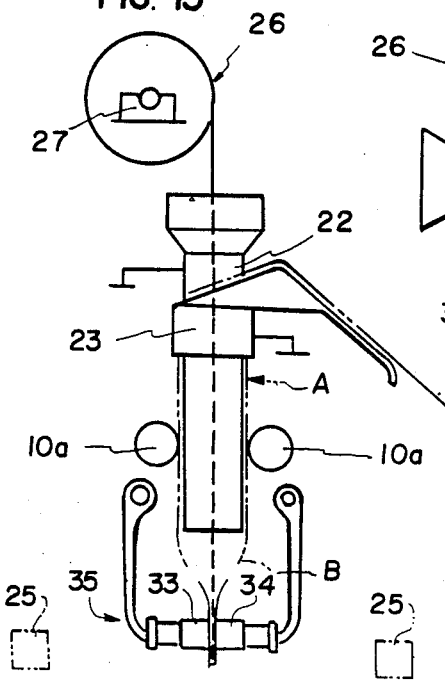
FIG. 15 is a side view showing a principal portion of another embodiment of the present invention as applied to the apparatus shown in FIG. 2.
Figure 17:
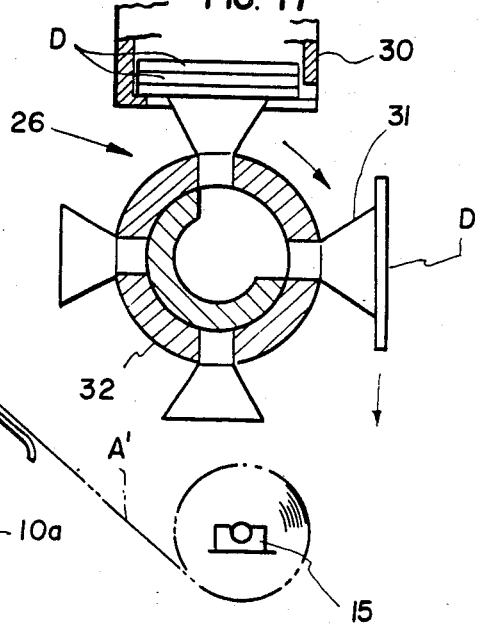
FIG. 17 is a vertical cross-sectional side view of one form of means for supplying individual pieces of reinforement.
Figure 16:
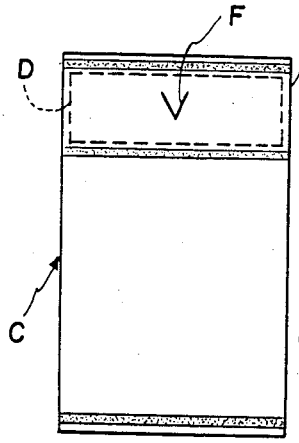
FIG. 16(*a*) to FIG. 16(*f*) are front views of six sealed packs as obtained in accordance with the present invention, each having a different form of opening for suspension.
Figure 16:
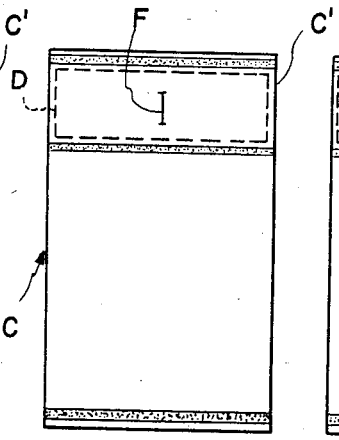
Figure 16:
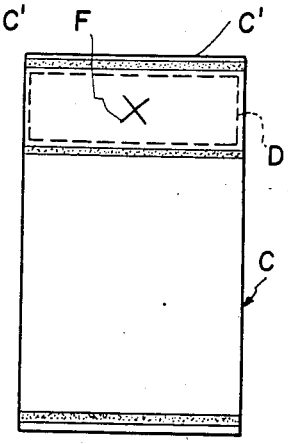
Figure 16:
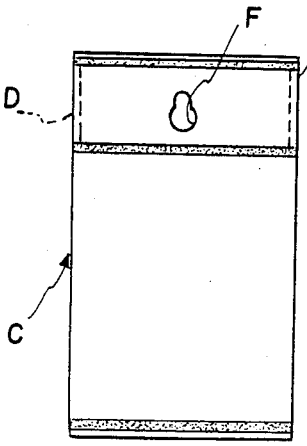
Figure 16:
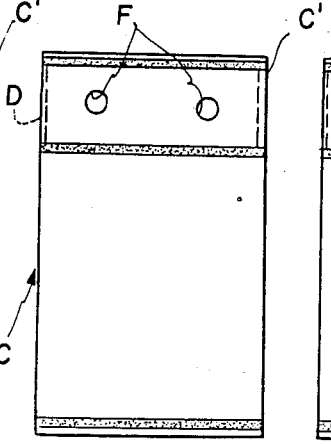
Figure 16:
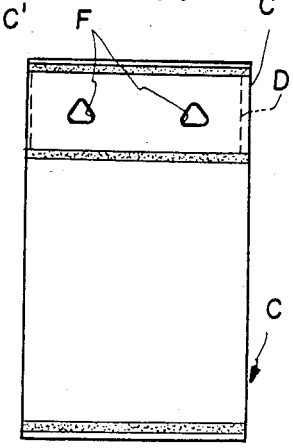

The supply means 26 shown in FIG. 15 and applied to the packing apparatus of the type shown in FIG. 2 lacks intermittent transfer means 28 and cutting means 29, but it is constructed so as to be capable of feeding the strip-like reinforcing material D1 into the foremost bag section B in operative connection with the intermittent rollers 10*a* for intermittently downwardly conveying the bag material A. The supply means 26 shown in FIG. 17 is arranged to supply an individual card-like reinforcing material D of a predetermined shape and size into a dependent bag section B of the bag material A and comprises a vertical cylindrical guide member 30 in which a plurality of the reinforcements D are accommodated in stacked relationship, and an intermittent rotor 32 provided immediately below the guide member 30 and having a plurality of radially projecting suckers 31 which are adapted to intermittently take out and feed the reinforcing sections D one by one when rotated.

Indicated by reference numeral 35 is a lateral processing apparatus for making an opening F for suspention in the dependent foremost bag section B of the bag material A and the reinforcing material D supplied therein.

The lateral processing apparatus 35 shown in FIG. 11 comprises a pair of mutually facing processing assemblies arranged to be horizontally moved toward and away from each other at the level of the lower portion of the dependent foremost bag section B. As shown in FIG. 11, one of the assemblies is provided with a punching member 33 for making the opening F which is adapted to slidably engage with a die member 34 mounted on the other assembly.

When the pair of processing assemblies are away from each other, the foremost bag section B and the reinforcing material D supplied thereinto are fed into a space therebetween, then the processing assemblies are moved toward each other to make an opening F in the lower portion of the bag section B and the reinforcing material D by means of the punching member 33 and die member 34, immediately before goods E are filled in the bag section B by the goods supply means 21, whereby the bag section is given a reinforced handle portion C' having an opening F for suspension. And then, the processing assemblies are moved away from each other and returned to their original position shown in FIG. 11.

Figures 7, 8, 9, 10:
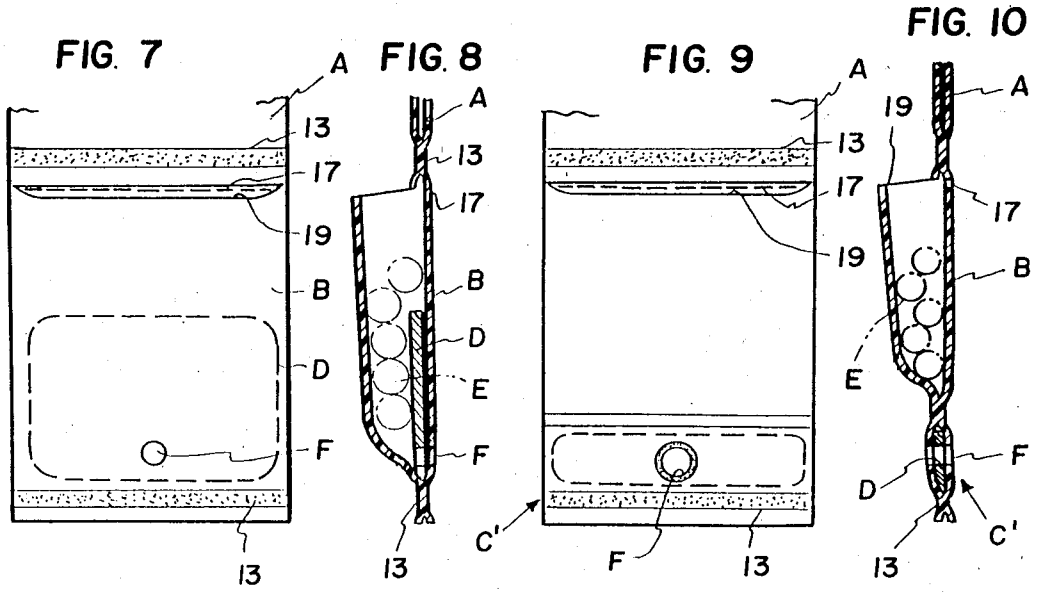
FIG. 7 is a front view of an example of a bag section in which a reinforcing material is attached to the bag section according to the present invention.
FIG. 8 is a vertical cross-sectional view of FIG. 7.
FIG. 9 is a front view of another example of a bag section in which a reinforcing material is attached to the bag section according to the present invention.
FIG. 10 is a vertical cross-sectional view of FIG. 9.

If and when the punching member 33 is of a heating type and the reinforcing material D is of heat-weldable material, then reinforcing material D and bag section B will be heat-welded with each other also at their portions surrounding the opening F to thereby provide it with a strengthened side wall as shown for example, in FIG. 9.

Figure 13:
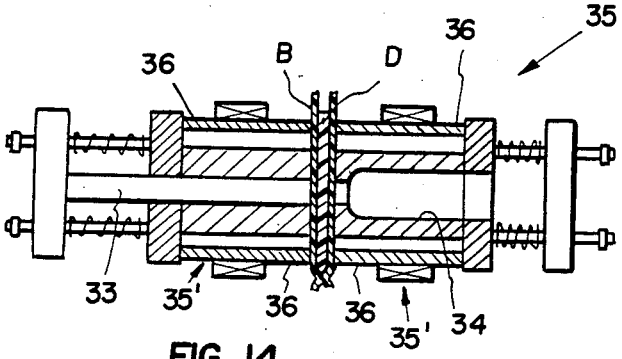
FIG. 13 is a vertical cross-sectional side view of one form of a lateral processing apparatus for providing a bag section with a reinforced handle portion having an opening, illustrating the state in which two component assemblies of the apparatus are operating.

In FIG. 13, there is shown another form of the lateral processing apparatus in which each of the two assemblies 35' is provided with upper and lower heat-sealers 36 between which the punching means is located and which extend transversely, respectively. With this type of processing apparatus, a heat-weldable reinforcing material D can be heat-welded at its upper and lower portions to the lower portion of the bag section B.

Figure 14:
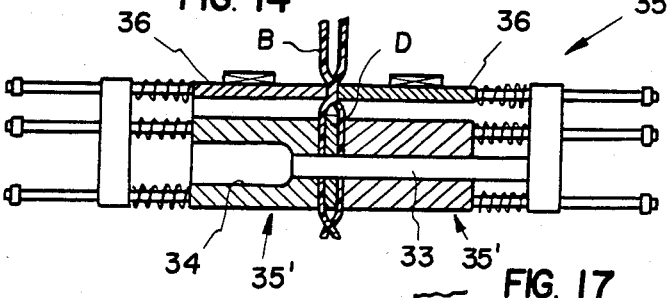
FIG. 14 is a vertical cross-sectional side view of another form of the lateral processing apparatus in its operative condition.

In FIG. 14, there is shown a further form of the lateral processing apparatus in which each of the two assemblies 35' is provided, at its upper portion, with a transversely extending heat-sealer 36. With this form of processing apparatus, the bag section B can be transversely heat-sealed at a portion immediately above the lower portion in which the reinforcing material D is located, whereby a sealed pack C having a strengthened handle portion C' can be obtained.

The processing apparatus 35 shown in FIG. 15 is the one as applied to the packing apparatus of the type shown in FIG. 2. This processing apparatus 35 is arranged to operate after a bag section B has been formed by heat-sealing the bag material A by means of heat-sealers 12. The processing apparatus as applied to the packing apparatus of the type shown in FIG. 15, is shown in FIG. 3. As shown, the punching member 33 and die member 34 are located at the level of the lower limit of stroke of the heat-sealing means 25 which serves also as a bag material transfer means.

The packing apparatus of the type shown in FIG. 15 may be modified such that instead of the provision of the processing apparatus 35 comprising a pinching member 33 and a die member 34, such members 33 and 34 are mounted on the heat-sealers 25, respectively.

A mechanism used for operating such a processing apparatus is sequentially controlled by sequential control means.

Figure 5:
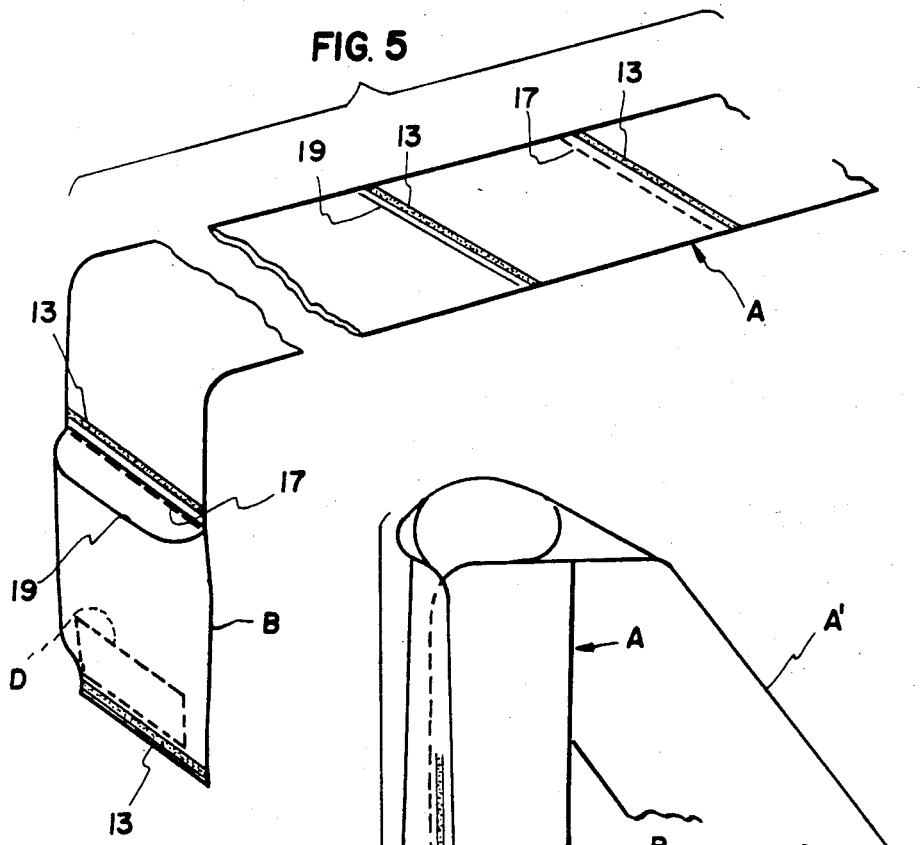
FIG. 5 is a perspective view of a bag material as used in the apparatus shown in FIG. 1.

It is to be noted that in the packing apparatus of the type which is shown in FIG. 15 and which lacks transfer means 28 for transferring the strip-like reinforcing material D1 and cutting means 29 for cutting it, the reinforcing material D1 is caused to be transferred, together with the bag material A, as shown in FIG. 5, and the cutting means 29 is replaced by means for cutting off the foremost bag section from the subsequent bag section.

If and when the bag material A is made of a transparend or semi-transparent synthetic resin, then a colorful or printed reinforcing material can be used.

In cases where a transversely extending sealed portion is formed to provide a partition between the handle portion of the bag section and the remaining portion thereof as shown in FIG. 10, goods E do not come into contact with the reinforcing material secured to the bag section and accordingly, such a form of bag is suitable for packing of relatively soft goods which tend to be deformed by contact with reinforcing material D and/or food-stuff which require a sanitary space.

Thus, in accordance with the present invention, individual sealed packs which can be suspended for a display can be automatically obtained without additional treatments.

What we claim is:

1. In a process for the automatic packing of articles comprising the steps of: intermittently moving a tubular bag material of heat-sealable thermoplastic synthetic resin during active time periods having inactive periods therebetween by a distance corresponding to the length of a single bag to be formed using intermittent conveyor means; heat-sealing said bag material transversely thereacross with respect to a moving direction of said bag material to form at its leading end portion a depending foremost bag section for packing of articles during each inactive period of said intermittent conveyor means; charging goods into the depending foremost bag section of said bag material; heat-sealing an upper portion of the goods-charged depending foremost bag section transversely thereacross; and separating the sealed bag section from a subsequent bag section of said bag material, the improvement comprising the steps of; supplying a reinforcing material into the depending foremost bag section and placing the reinforcing material between opposite walls of the bag section at a region adjacent a transversely extending lower seal of said foremost bag section, said reinforcing material having greater material strength than that of said bag material so as to provide said region with a greatly reinforced handle portion; and forming an opening for suspension of an individual sealed bag section to be produced, by piercing through said walls and said reinforcing material placed therebetween by punch and die means; said steps of supplying a reinforcing material into said foremost bag section and placing it between said walls at said region and forming said opening being performed immediately before the goods are charged into said foremost bag section during each inactive period of said intermittent conveyor means, whereby individual sealed bag sections each having a reinforced handle portion with an opening for suspension can be automatically successively obtained.

2. An improved process as set forth in claim 1, wherein said reinforcing material is selected from the group consisting of a heat-weldable thick sheet, a heat-weldable hard sheet, a heat-weldable foamed sheet and a paper coated with heat-weldable material.

3. An improved process as set forth in claim 1, wherein the reinforcing material is made of a hardboard.

4. An improved process as set forth in claim 1, wherein the reinforcing material is selected from the group consisting of an individual preformed card-like reinforcing material and a reinforcing material section severed from a strip-like reinforcing material immediately before goods are charged into the foremost bag section.

5. An improved process as set forth in claim 1, wherein the reinforcing material is of a heat-weldable material and is heat-welded to the side walls of the bag section simultaneously with the formation of an opening for suspension in said walls and in the reinforcing material.

6. An improved process as set forth in claim 1, wherein the foremost bag section is heat-sealed transversely thereacross at a portion immediately above the region within which a reinforcing material is placed.

* * * * *